US009655169B2

(12) United States Patent
Zirgel

(10) Patent No.: US 9,655,169 B2
(45) Date of Patent: May 16, 2017

(54) ELECTRIC HEATER

(71) Applicant: MAHLE International GmbH, Stuttgart (DE)

(72) Inventor: Thomas Zirgel, Heidolsheim (FR)

(73) Assignee: MAHLE International GmbH, Stuttgart (DE)

( * ) Notice: Subject to any disclaimer, the term of this patent is extended or adjusted under 35 U.S.C. 154(b) by 137 days.

(21) Appl. No.: 14/683,776

(22) Filed: Apr. 10, 2015

(65) Prior Publication Data

US 2015/0296568 A1 Oct. 15, 2015

(30) Foreign Application Priority Data

Apr. 14, 2014 (EP) ..... 14290109

(51) Int. Cl.

| | |
|---|---|
| ***H05B 1/02*** | (2006.01) |
| ***H05B 3/42*** | (2006.01) |
| ***F24H 1/12*** | (2006.01) |
| ***H05B 3/06*** | (2006.01) |
| *F24H 3/04* | (2006.01) |
| *F24H 9/18* | (2006.01) |

(52) U.S. Cl.

CPC ..... *H05B 3/42* (2013.01); *F24H 1/121* (2013.01); *F24H 3/0441* (2013.01); *H05B 1/0236* (2013.01); *H05B 3/06* (2013.01); *F24H 3/0435* (2013.01); *F24H 9/1872* (2013.01); *F24H 2250/04* (2013.01)

(58) Field of Classification Search

CPC ..... H05B 3/42; H05B 1/0236; H05B 3/40; H05B 3/12; H05B 3/06; H05B 3/50; H05B 3/32; F24H 1/121; F24H 3/9435; F24H 3/0441; F24H 9/1972; F24H 2250/04

USPC ..... 219/534, 520.532, 530

See application file for complete search history.

(56) References Cited

U.S. PATENT DOCUMENTS

| | | | | | |
|---|---|---|---|---|---|
| 3,225,321 | A | * | 12/1965 | Walter | H05B 3/00 174/76 |
| 3,839,623 | A | * | 10/1974 | Portmann | H05B 3/46 174/75 B |
| 3,970,817 | A | * | 7/1976 | Boyd | H05B 3/48 219/209 |
| 5,034,595 | A | * | 7/1991 | Grendys | H05B 3/06 219/541 |

(Continued)

FOREIGN PATENT DOCUMENTS

| | | |
|---|---|---|
| GB | 273403 | 7/1927 |

*Primary Examiner* — Mark Paschall

(74) *Attorney, Agent, or Firm* — Muncy, Geissler, Olds & Lowe, P.C.

(57) ABSTRACT

An electric heater for an automobile vehicle, with an electric heating element, which is connectable to an electric power source, with an insulating element and with a tube with the electric heating element being placed inside the tube and being electrically insulated from the tube, with the tube having at least one opening through which the insulating element and the electric heating element can be inserted into the tube. The electric heater features a safety element, which is plugged into the at least one opening of the tube, with the safety element having at least one distance element, which defines the orientation of the electric heating element and/or the insulating element in relation to the tube. Furthermore the invention relates to a heat exchanger with at least one electric heater.

13 Claims, 2 Drawing Sheets

(56) References Cited

U.S. PATENT DOCUMENTS

| | | | | |
|---|---|---|---|---|
| 6,124,579 | A * | 9/2000 | Steinhauser | H05B 1/0291 219/523 |
| 6,432,344 | B1 * | 8/2002 | Eckman | H05B 3/04 264/263 |
| 8,383,996 | B2 * | 2/2013 | Woelper | H05B 3/44 219/202 |
| 9,398,641 | B2 * | 7/2016 | Bohlender | |
| 2004/0226938 | A1 * | 11/2004 | Nakajima | H05B 3/06 219/548 |
| 2012/0061366 | A1 | 3/2012 | Kohl et al. | |
| 2013/0161308 | A1 | 6/2013 | Bohlender et al. | |

* cited by examiner

ELECTRIC HEATER

This nonprovisional application claims priority under 35 U.S.C. §119(a) to European Patent Application No. EP14290109.9, which was filed on Apr. 14, 2014, and which is herein incorporated by reference.

BACKGROUND OF THE INVENTION

Field of the Invention

The present invention relates to an electric heater especially for an automobile vehicle, with an electric heating element, which is connectable to an electric power source, with an insulating element and with a tube with the electric heating element being placed inside the tube and being electrically insulated from the tube, with the tube having at least one opening, through which the insulating element and the electric heating element can be inserted into the tube.

Description of the Background Art

Electric heaters usually have at least one heating element, which can be heated by applying an electric current to the element. The heat is then transported via fins or other thermally conductive parts to a heat sink. The heat sink can thus be heated by the heating element. The heat sink can be represented by a fluid, which flows through a heat exchanger or over the surface of the heat exchanger.

In embodiments that are known in the conventional art the electric heating element, which is advantageously connected to a positive pole and a negative pole of an electrical power source, is positioned between insulating elements before it is placed within a tube or attached to the outer surface of a tube. The insulating elements are used to avoid short circuits between the electric heating element and other structures, by which the electric heating element is surrounded, e.g. the tube or heat transmitting fins. The elements are usually press-fitted with each other to avoid relative movement between the elements. The elements can be press-fitted with each other or glued to each other to avoid relative movement between the elements.

Especially electric heaters within automobile vehicles can be subject to mechanical stress due to the operation of the vehicle. The mechanical stress can lead to relative movement between the insulating elements, the electric heating elements and the surrounding tube. The relative movement can thereby lead to damage at the insulating elements or to a direct contact between the electric heating elements and a structure, which is normally insulated against the electric current of the electric heating element.

This is disadvantageous as a direct contact, which is caused by the relative movement or the damage of the insulating elements, can lead to short circuits, which pose a potential risk for human beings. Short circuits are especially dangerous as human beings can accidently be exposed to an electric shock, which can lead to injuries and possibly death.

SUMMARY OF THE INVENTION

It is therefore an object of the present invention to provide an electric heater, which possesses an additional safety element, which can reduce the relative movement between the elements of an electric heater. Also, the electric heater should be easily producible. Furthermore it is the object of the invention to provide a heat exchanger with at least one electric heater.

According to an embodiment of the invention, an electric heater for an automobile vehicle is provided, with an electric heating element, which is connectable to an electric power source, with an insulating element and with a tube with the electric heating element being placed inside the tube and being electrically insulated from the tube, with the tube having at least one opening, through which the insulating element and the electric heating element can be inserted into the tube, where the electric heater features a safety element, which is plugged into the at least one opening of the tube, with the safety element having at least one distance element, which defines the orientation of the electric heating element and/or the insulating element in relation to the tube.

The electric heating element has a frame, which has recesses for one or more thermoelectric elements, e.g. positive temperature coefficient (PTC) elements. Furthermore the electric heating element features electrodes, through which the thermoelectric elements are connected to a power source. The electrodes can be thin plate-shaped elements, which cover the thermoelectric elements in the recesses of the frame. To prevent short circuits the electrodes are covered by insulating elements, e.g. ceramic elements. These ceramic elements can be connected to the electric heating elements by the method of press-fitting. Due to mechanical stress, that can be applied onto the electric heater, a relative movement between the electric heating element and the insulating element can occur, which can cause short circuits. Short circuits can damage the functionality of the system or the system itself and can furthermore pose a threat to human beings.

By plugging a safety element into one of the openings of a tube with a distance element that defines the distance between the inner wall of the tube and the electric heating element and/or the insulating element the development of short circuits can be avoided, as the relative movement between the electric heating element and/or the insulating element can be limited.

According to an embodiment of the invention, the safety element can have an at least partially circumferential groove, in which the wall of the tube can be received.

A groove is beneficial, as the wall of the tube can be inserted into the groove and thus fixated to the safety element. This helps to position the safety element against the tube and thus makes the installation of the safety element easier.

In an embodiment, the distance element protrudes in a rectangular direction from a base of the safety element. As the base is parallel to the opening of the tube, the distance element reaches into the tube in a direction parallel to the middle axis of the tube. The middle axis thereby is the axis that runs in the direction along which the safety element can be inserted into the tube.

It is very advantageous, if the opening of the tube can be covered by the base at least partially. By a base that is sized large enough to cover the opening of the tube, the tube can be sealed off by plugging the safety element into the tube. This helps to prevent dirt and other unwanted particles, e.g. fluids, from being introduced into the tube. This helps to reduce the failure rate due to contamination.

The safety element can have a boundary area, which protrudes in a rectangular direction from the base. By a boundary area, which protrudes in a rectangular direction from the base, a recess can be built, in which the tube can easily be inserted. The boundary area furthermore can encase the end section of the tube that is inserted into the recess, thus the connection between the safety element and the tube can be improved.

The groove, in which the wall of the tube can be received, can be formed between the distance element and the boundary area of the safety element. This design is beneficial, as it makes the installation of the safety element easier.

the distance element can create a defined distance between the inner wall of the tube and the insulating element and/or the electric heating element. A defined distance between the inner wall of the tube and the elements that are arranged within the tube is beneficial, as short circuits due to direct contact between the elements can be avoided.

The distance element can limit a movement of the electric heating element and/or the insulating element relative to the tube in a longitudinal direction and/or in a rotational direction.

The relative movement in a rotational direction can be limited, as rotational relative movements, which result in torsional tension, can be reduced or completely avoided. This helps to improve the functionality over the whole lifetime of the electric heater, as damages due to torsional tensions can be reduced or avoided. Especially the electric heating elements and the insulating elements are very damageable by torsional tension, thus torsional tension should be avoided.

The boundary area and/or the distance element can have at least one rib element, which is facing into the groove. A rib element is beneficial as it can create friction on the outer wall of the tube. This is positive as it improves the connection between the safety element and the tube as a force closure is created. In another embodiment, the outer wall can have creases, in which the rib elements can be inserted. The rib elements can thereby create a form closure between the tube and the safety element.

In an embodiment, the safety element can have an at least partially circumferential flange, which protrudes in a rectangular direction from the boundary area, with the flange facing outwards.

An outwards facing flange is especially beneficial, for example, if a multitude of tubes is aligned next to each other to form an electric heater. The flange can thereby be used to create a distance between adjacent tubes, which makes the assembly of an electric heater easier. Especially as usually heat transmitting fins are arranged between the tubes and thus a defined constant distance between the tubes is needed.

The safety element can have two distance elements protruding in a rectangular direction from the base with each of the distance elements featuring a recess to receive the electric heating element and/or the insulating element. Two distance elements, which can be finger-shaped, are beneficial as they can encase the insulating element on opposing ends. This enhances the stability and helps to limit the relative movement on both ends of the insulating element. The distance elements encase the insulating element on the two narrow sides of the tube.

The distance element creates an air gap between the insulating element and/or the heating element and the inner wall of the tube. In an embodiment the distance element can be in direct contact with the inner wall of the tube and with the insulating element and/or the heating element to avoid relative movement.

In another embodiment, the tube can have two openings at opposing ends with one safety element being plugged into each opening respectively. A tube with two openings at opposing ends is beneficial, as two safety elements can be used to fixate the insulating element within the tube. This helps to improve the stability of the electric heater and furthermore to avoid short circuits on both end sections of the tube.

In an embodiment, the safety element can be made out of a non-conductive material. A non-conductive material is beneficial, as it helps to prevent short circuits and thus improves the insulating capabilities.

Furthermore, the distance elements and/or the base can be made out of a material, which is inflexible enough to avoid relative movement between the tube and the insulating element and/or the electric heating element. Through an inflexible material, it is possible to avoid relative movement between the insulating element and the inner wall of the tube and thus it is possible to avoid electric short circuits.

The distance elements can be set apart from the inner wall of the tube such that an air gap is created between the distance elements and the inner wall of the tube. The air gap is beneficial as it ensures the electric insulation between the electric heating element and the tube. The distance element can either be built in a way that it has a direct contact with the inner wall of the tube or in a way that it is set apart from the tube. If the distance element is set apart from the tube it needs to be rigid enough to avoid relative movement between the insulating element and/or the heating element and the tube to avoid short circuits.

Furthermore a heat exchanger with at least one electric heater is beneficial, with the heat exchanger featuring a multitude of fluid-tubes, which are spaced apart from each other, with the fluid-tubes and the electric heaters being arranged in an alternating order, with a multitude of heat transmitting fins arranged between the fluid-tubes and the electric heaters, where a first fluid can be streamed through the fluid-tubes and a second fluid can be streamed around the fluid-tubes and the electric heaters.

In a heat exchanger with electric heaters it is possible to generate additional heat by applying an electric current on the electric heating elements. Therefore the overall performance of the heat exchanger can be improved. Such a heat exchanger is very beneficial in situations where the heat, which is generated through the conventional part of the heat exchanger, is not sufficient.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
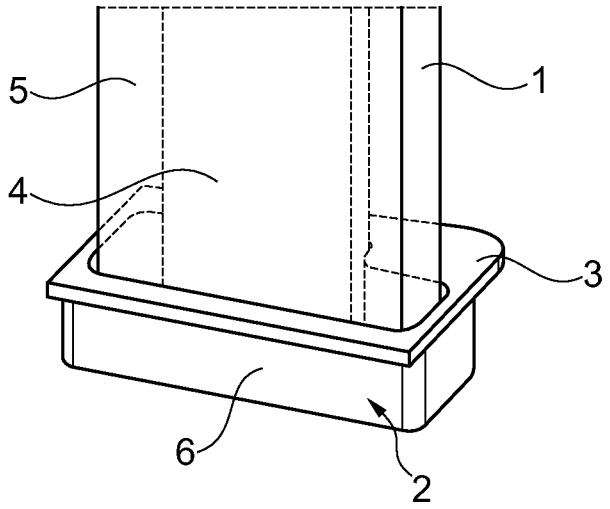
FIG. 1 shows a perspective view of one end section of a tube of a heat exchanger where an electric heating element, which is encased by two ceramic insulating elements, is integrated into the tube, with the tube having a safety element plugged into the opening of the tube to position the electric heating element and the insulating element relative to the inner wall of tube.

FIG. 1 shows the end section of a tube 1, where the tube 1 is a flat tube 1, which features two broadsides that are arranged parallel to each other and two narrow sides that are also arranged parallel to each other. The narrow sides thereby connect the broadsides to form the tube 1. The tube 1 can be built out of only one element or can consist of several elements, which can be connected with each other to form the tube. In an advantageous embodiment the tube is made out of a material, which has a good thermal conductivity.

Inside of the tube is an electric heating element 4, which is arranged between two insulating elements 5. The electric heating element 4 is connected to a positive pole and a negative pole of a power source. The power source is not shown in FIG. 1.

The electric heating element 4 and the insulating elements 5 can be press-fitted together. In other preferred embodiments further fixation means, such as glue, can be used to connect the electric heating element 4 to the insulating elements 5. The insulating elements 5 can be arranged within the tube 1 in a way that an air gap is created between the insulating elements 5 and the inner wall of the tube 1. In a preferred embodiment the air gap is created between the narrow sides of the tube 1 and the insulating elements 5, whereas the broadsides of the tube 1 are press-fitted to the insulating elements 5.

The FIG. 1 furthermore shows a safety element 2, which is plugged in the downwards facing opening of the tube 1. The safety element 2 encases the tube 1 thereby at least partially with a boundary area 6. The safety element 2 furthermore features a circumferential flange 3, which protrudes in a direction that is rectangular to the boundary area 6 and facing outwards. The flange 3 can be used to create defined distances between tubes 1 that are arranged adjacent to each other.

In an embodiment the safety element 2 is made out of a non-conductive and/or elastic material. The non-conductive material helps to create an insulation. Furthermore the elastic properties of the material makes the assembly of the safety element 2 on the tube 1 easier.

The safety element 2 features a recess, in which the tube 1 can be inserted. The recess is formed between the boundary area 6, which protrudes in a rectangular direction from the flat base of the safety element 2, and the distance elements 8, which protrudes in a direction parallel to the boundary area 6 from the base of the safety element 2.

Figure 2:
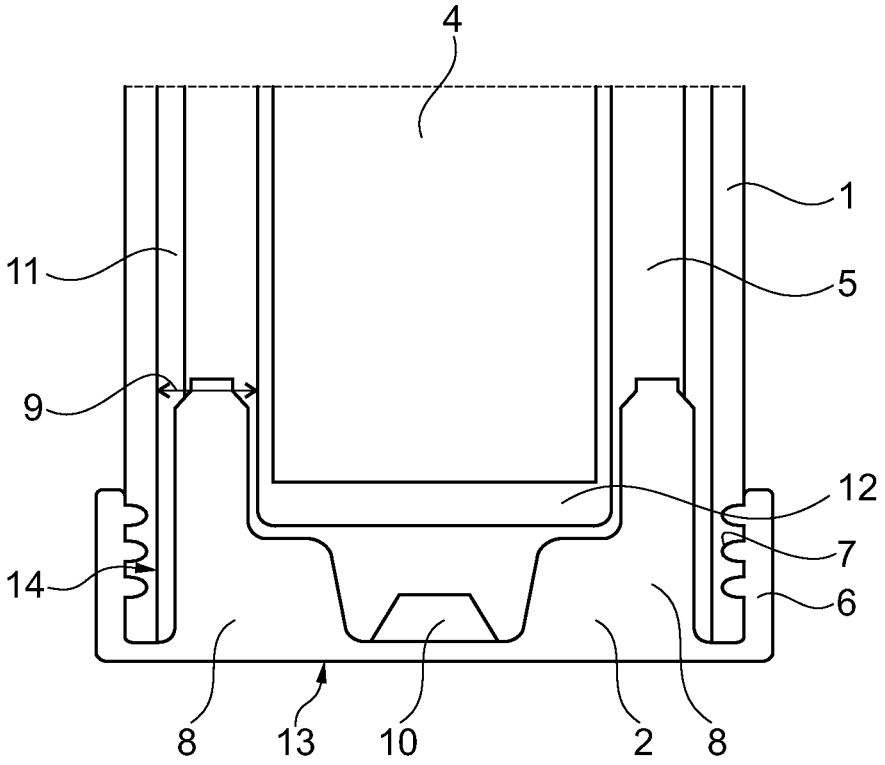
FIG. 2 shows a cross-sectional view of the tube according to FIG. 1 where the insulating element is recessed into the distance elements of the safety element with the safety element having a circumferential boundary area, which encases the outer wall of end section of the tube.

FIG. 2 shows a cross-sectional view of the tube 1, which is already shown in FIG. 1. The cut runs parallel to the broadsides of the tube 1 and cuts through the middle axis of the tube 1.

In FIG. 2 it can be seen, that the electric heating elements 4 are placed within a frame, which is then covered by the insulating elements 5. The electric heating element 4 can be fitted into the recesses free from backlash, so that no relative movement is possible. Alternatively an air gap 12 can be formed between the electric heating element 4 and the surrounding frame.

As can be seen in FIG. 2, the insulating elements 5 are spaced apart from the inner wall of the narrow sides of the tube 1 in a way that an air gap 11 is created between the inner wall and the insulating elements 5.

In the embodiment shown in FIG. 2 the electric heating element 4 is encased by the insulating elements 5 only in the direction of the broadsides of the tube 1 but not in the direction of the narrow sides of the tube. Along the direction of the narrow sides, the electric heating element 4 might at least be partially encased by the insulating elements 5. Relative movement between the electric heating element 4 and the insulating elements 5 can therefore lead to a direct contact between the electric heating element 4 and the inner wall of the tube 1, which may cause an electric short circuit and thus might be electrifying the tube 1.

The safety element 2 features a base 13 from which the boundary area 6 protrudes in a rectangular direction. Furthermore two distance elements 8 protrude from the base 13 in the same direction parallel to the boundary area 6. Between the distance elements 8 and the boundary area 6 a groove 14 is built, in which the tube 1 or more specific the wall of the tube 1, can be inserted. While the insertion of the tube 1 into the groove 14, the distance elements 8 are inserted into the tube 1 while the boundary area 6 encases the outer walls of the tube 1.

The boundary area 6 features at least partially circumferential rib elements 7, which protrude from the boundary area 6 into the groove 14. These rib elements 7 are in direct contact with the outer wall of the tube 1. The rib elements 7 can thereby be elastic in such a way, that they are compressed while the insertion of the tube 1, so that a pressure on the outer wall of the tube 1 is created, which leads to a better fixation of the tube 1 in the safety element 2.

In an alternative embodiment the tube can show a number of creases on the outer wall, which correspond with the rib elements in such a way that the rib elements are inserted into the creases while the insertion of the tube. This will create a form closure between the safety element and the tube and thus improves the connection.

The distance elements 8 each have a c-shaped recess into which the insulating elements 5 are inserted and thus fixated. Each of the c-shaped recesses thereby encases especially the narrow side of the insulating elements 5 with its base section and each of the broadsides at least partially with the free flanks of the c-shaped recess. Bedstops are positioned within the recesses, which limit the way of travel of the insulating elements 5 into the recesses. The insulating elements 5 are predominantly encased by the distance elements 8 at the narrow sides of the tube 1. In an alternative embodiment the two distance elements can be built as one single distance element, which encases the complete end section of the insulating elements 5. The outwards facing sides of the distance element and the inwards facing sides of the boundary area 6 thereby form the groove into which the wall of the tube can be inserted.

The distance elements 8 furthermore feature one ledge 9, which creates a defined distance between the distance elements 8 and the inner wall of the tube 1. The ledge 9 thereby helps to avoid direct contact between the insulating elements 5 and/or the electric heating element 4 and the inner wall of the tube 1.

In an alternative embodiment, the distance elements do not cover the electric heating element in the direction of the broadsides and/or in the direction of the narrow sides. This is especially beneficial, as the heat transmission in these directions is not negatively influenced by the material of the safety element. Usually the main portion of the heat is transferred via the broadsides of the tube.

In FIG. 2 the insulating elements 5 possess a cavity 10 between the base 13 and the insulating elements 5. In an alternative embodiment the base can feature a further ledge, which can be inserted into the cavity, to further fixate the insulating elements against the safety element.

Figure 3:
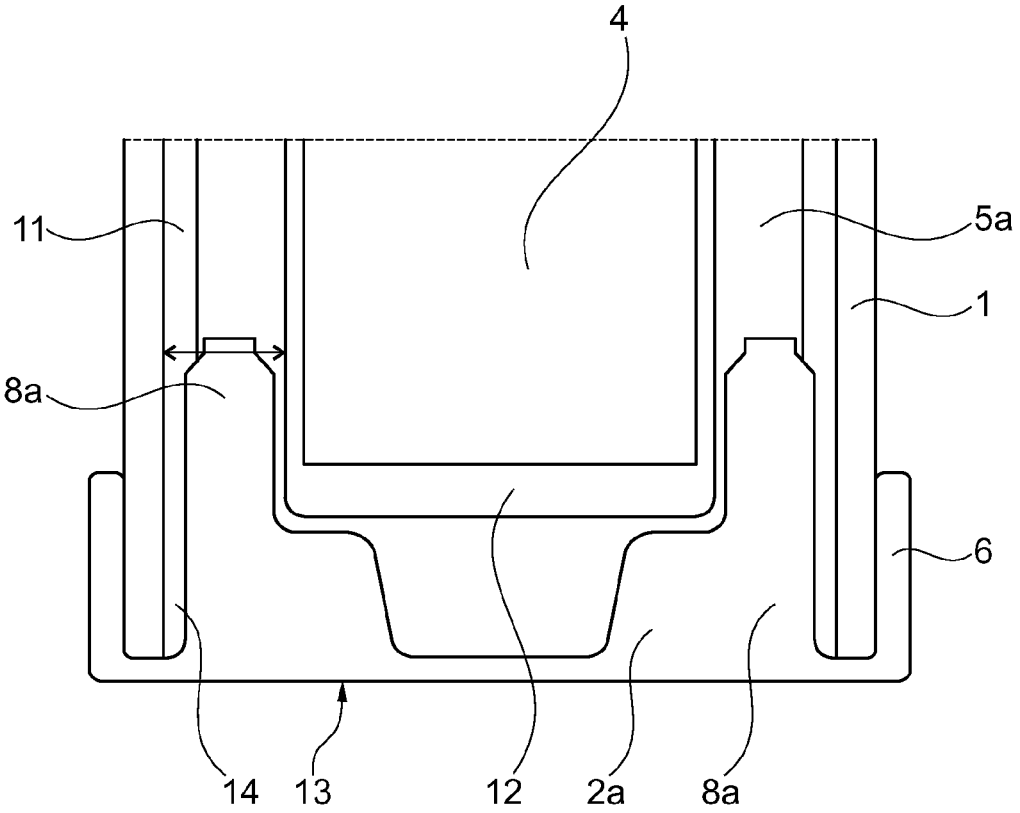
FIG. 3 shows an embodiment of the safety element, which is plugged into the opening of a tube as shown in FIG. 2.

FIG. 3 shows an alternative embodiment of the safety element 2, which is already shown in FIG. 2. The safety element 2*a* of FIG. 3 features two distance elements 8*a*, which protrude from the base 13 of the safety element 2*a*. As a modification from the distance elements 8 from FIG. 2 the distance elements 8*a* do not possess the ledges 9. Therefore the distance elements 8*a* have no direct contact with the inner wall of the tube 1. Even without theses ledges 9 the distance elements 8*a* create an air gap 11 between the insulating element 5*a* and the tube 1, which is necessary to avoid electric short circuits between the tube 1 and the insulating element 5*a* and/or the electric heating element 4, which is arranged within the insulating element 5*a*.

In an embodiment the distance elements 8*a* and/or the base 13 of the safety element 2*a* are made of a material, which is inflexible enough to give enough stability to the insulating element 5*a* in order to avoid relative movement of the insulating element 5*a* and the distance element 8*a* relative to the tube 1. But even if the distance elements 8*a* would allow enough movement of the insulating element 5*a*, the material of the distance elements 8*a*, which encases the insulating element 5*a*, would act as an insulation between the insulating element 5*a* and the inner wall of the tube 1.

As already described in FIG. 2 the insulating element 5*a* is encased by the distance elements 8*a* on the narrow sides of the tube 1, so that in case of a relative movement the distance elements 8*a* would come into direct contact with the inner wall of the tube 1 instead of the insulating element 5*a* or the electric heating element 4.

A further modification shown in FIG. 3 is that the boundary area 6 shows no rib elements protruding from the boundary area 6 in the direction of the center of the tube 1. The fixation between the outer surface of the tube 1 and the inner surface of the boundary area 6 is formed by a friction bond, rather than by a form closure as shown in FIG. 2.

Furthermore the insulating element 5*a* does not feature a cavity like the cavity 10 that is shown in FIG. 2. The down-facing part of the insulating element 5*a* rests against the inner surface of the base 13 of the safety element 2*a*. The increased contact area between the insulating element 5*a* and the safety element 2*a* leads to a higher stability of the connection between the safety element 2*a* and the insulating element 5*a*.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electric heater for an automobile vehicle, the electric heater comprising:

an electric heating element that is connectable to an electric power source;

an insulating element;

a tube, the electric heating element being placed inside the tube and being electrically insulated from the tube, the tube having at least one opening through which the insulating element and the electric heating element are inserted into the tube; and a safety element that is plugged into the at least one opening of the tube, the safety element having at least one distance element, which defines an orientation of the electric heating element or the insulating element in relation to the tube, wherein the distance element creates a defined distance between the inner wall of the tube and the insulating element.

2. The electric heater as claimed in claim 1, wherein the distance element creates a defined distance between the inner wall of the tube and the electric heating element.

3. The electric heater as claimed in claim 2, wherein the defined distance is an air gap between the insulating element and/or the heating element and the inner wall of the tube.

4. The electric heater as claimed in claim 1, wherein the distance element protrudes in a rectangular direction from a base of the safety element.

5. The electric heater as claimed in claim 1, wherein the safety element has a boundary area, which protrudes in a rectangular direction from the base.

6. The electric heater as claimed in claim 1, wherein the distance element limits the movement of the electric heating element and/or the insulating element relative to the tube in a longitudinal direction and/or in a rotational direction.

7. The electric heater as claimed in claim 1, further comprising a cavity between a base of the safety element and the insulating element.

8. An electric heater for an automobile vehicle, the electric heater comprising:

an electric heating element that is connectable to an electric power source;

an insulating element;

a tube, the electric heating element being placed inside the tube and being electrically insulated from the tube, the tube having at least one opening through which the insulating element and the electric heating element are inserted into the tube; and a safety element that is plugged into the at least one opening of the tube, the safety element having at least one distance element, which defines an orientation of the electric heating element or the insulating element in relation to the tube, wherein the safety element has an at least partially circumferential groove in which the wall of the tube is received.

9. The electric heater as claimed in claim 8, wherein the safety element has a boundary area, which protrudes in a rectangular direction from the base, and wherein the boundary area and/or the distance element features at least one rib element, which faces into the groove.

10. An electric heater for an automobile vehicle, the electric heater comprising:

an electric heating element that is connectable to an electric power source;

an insulating element;

a tube, the electric heating element being placed inside the tube and being electrically insulated from the tube, the tube having at least one opening through which the insulating element and the electric heating element are inserted into the tube; and a safety element that is plugged into the at least one opening of the tube, the safety element having at least one distance element, which defines an orientation of the electric heating element or the insulating element in relation to the tube, wherein the safety element has two distance elements protruding in a rectangular direction from a base of the safety element with each of the distance elements having a recess to receive the electric heating element and/or the insulating element.

11. The electric heater as claimed in claim 10, wherein the distance elements and/or the base are made out of a material, which is inflexible enough to avoid relative movement between the tube and the insulating element and/or the electric heating element.

12. The electric heater as claimed in claim 10, wherein the distance elements are set apart from the inner wall of the tube such that an air gap is created between the distance elements and the inner wall of the tube.

13. A heat exchanger with at least one electric heater, the electric heater comprising:

an electric heating element that is connectable to an electric power source;

an insulating element;

a tube, the electric heating element being placed inside the tube and being electrically insulated from the tube, the tube having at least one opening through which the insulating element and the electric heating element are inserted into the tube; and a safety element that is plugged into the at least one opening of the tube, the safety element having at least one distance element, which defines an orientation of the electric heating element or the insulating element in relation to the tube, wherein the heat exchanger comprises:

a plurality of fluid-tubes, which are spaced apart from each other, the fluid-tubes and electric heaters being arranged in an alternating order, and a plurality of heat transmitting fins being arranged between the fluid-tubes and the electric heaters, wherein a first fluid flows through the fluid-tubes and a second fluid flows around the fluid-tubes and the electric heaters.

* * * * *